US005782211A

United States Patent [19]

Kamimaru

[11] Patent Number: 5,782,211

[45] Date of Patent: Jul. 21, 1998

[54] ELECTROMAGNETICALLY OPERATED VALVE DRIVING SYSTEM

[75] Inventor: Shinji Kamimaru, Tokyo, Japan

[73] Assignee: Fuji Jukogyo Kabushiki Kaisha, Tokyo, Japan

[21] Appl. No.: 911,657

[22] Filed: Aug. 15, 1997

[30] Foreign Application Priority Data

Aug. 30, 1996 [JP] Japan ..... 8-230094

[51] Int. Cl.[6] ..... F01L 9/04

[52] U.S. Cl. ..... 123/90.11; 123/90.24

[58] Field of Search ..... 123/90.11, 90.24; 251/129.01, 129.05, 129.1

[56] References Cited

U.S. PATENT DOCUMENTS

| | | | |
|---|---|---|---|
| 4,955,334 | 9/1990 | Kawamura | 123/90.11 |
| 5,125,370 | 6/1992 | Kawamura | 123/90.11 |
| 5,671,705 | 9/1997 | Matsumoto et al. | 123/90.11 |

FOREIGN PATENT DOCUMENTS 61-76713 4/1986 Japan .

*Primary Examiner*—Weilun Lo
*Attorney, Agent, or Firm*—Martin A. Farber

[57] ABSTRACT

An electromagnetically operated valve driving system for driving an intake or exhaust valve of an engine comprises an opening solenoid, a closing solenoid, and a control apparatus for energizing or deenergizing these opening and closing solenoids. Springs are provided in order to balance a valve body on a specified position between the fully open and fully closed positions. Further, when the intake or exhaust valve is closed, the closing solenoid is deenergized for a very short time immediately before the intake or exhaust valve is fully closed so as to reduce a traveling speed of the valve body when said valve body is seated. Also, when the intake or exhaust valve is opened, the opening solenoid is deenergized for a very short time immediately before the intake or exhaust valve is fully opened so as to reduce a traveling speed of the valve body when the valve body is fully opened.

2 Claims, 8 Drawing Sheets

FIRST ENERGIZING CONTROL ROUTINE
( VALVE OPENING SOLENOID )

ELECTROMAGNETICALLY OPERATED VALVE DRIVING SYSTEM

BACKGROUND OF THE INVENTION

1. Field of the Invention

The present invention relates to an electromagnetically operated valve driving system for an internal combustion engine, particularly to an electromagnetically operated valve driving system capable of absorbing impacts when a valve is seated on a valve seat or fully open.

2. Prior Arts

An electromagnetically operated valve driving system is a valve driving mechanism for opening and closing intake and exhaust valves by means of electromagnetic force. The greatest advantage of the valve driving apparatus over the conventional camshaft driving valve mechanism is to be able to set opening and closing timing of valves arbitrarily and therefore the valve driving apparatus enables to operate an engine with an optimal valve timing according to engine operating conditions.

However, one of disadvantages of the valve driving apparatus is impacts caused when valves are seated on the valve seats or fully open. The impacts are caused by the valve motion accelerated by the magnetic force of solenoids or the rebound force of springs. Generally, impacts generate noises and an adverse effect on durability of valves as well.

As an example of techniques to solve the problem, there is Japanese Patent Application Laid-open Toku-Kai-Sho No. 61-76713 whose electromagnetically operated valve driving system comprises an electromagnetic solenoid for opening a valve (valve opening solenoid), an electromagnetic solenoid for closing a valve (valve closing solenoid) and an armature, disclosing a technique in which the impact at seating is alleviated by reducing the seating velocity of the valve by means of energizing the valve opening solenoid immediately before seating.

However, immediately before the valve is seated, since the armature is at the closest position to the valve closing solenoid and is at the remotest position from the valve opening solenoid, it is difficult to control the seating velocity of the valve due to a weak magnetic field of the valve opening solenoid.

SUMMARY OF THE INVENTION

It is an object of the present invention to provide an electromagnetically operated valve driving system capable of controlling the velocity of the valve immediately before the valve is fully opened or seated so as to alleviate the impact at seating or fully opening.

In accordance with a first aspect of the present invention, there is provided an electromagnetically operated valve driving system of an engine having a combustion chamber, an intake or exhaust valve including a valve body for opening and closing said combustion chamber, a valve stem for supporting the valve body, an armature connected with the valve stem, a first solenoid for attracting the armature and for driving the valve body so as to open said combustion chamber and a second solenoid for attracting the armature and for driving the valve body so as to close the combustion chamber, and a control apparatus for energizing or deenergizing the first and second solenoids, comprising:

at least one spring for balancing the valve body on a specified position between the fully open and fully closed positions of the valve body and for exerting a restoring force of the valve body; and valve closing control means for at least once stopping energizing said second solenoid immediately before said intake or exhaust valve is fully closed, so as to reduce a traveling speed of said valve body when said valve body is seated, when said intake or exhaust valve is closed.

In accordance with a second aspect of the present invention, there is provided an electromagnetically operated valve driving system of an engine having a combustion chamber, an intake or exhaust valve including a valve body for opening and closing the combustion chamber, a valve stem for supporting the valve body, an armature connected with the valve stem, a first solenoid for attracting the armature and for driving the valve body so as to open the combustion chamber and a second solenoid for attracting said armature and for driving the valve body so as to close the combustion chamber, and a control apparatus for energizing or deenergizing the first and second solenoids, comprising:

at least one spring for balancing the valve body on a specified position between the fully open and fully closed positions of the valve body and for exerting a restoring force of the valve body; and valve opening control means for at least once stopping energizing said first solenoid immediately before said intake or exhaust valve is fully opened, so as to reduce a traveling speed of said valve body when said valve body is fully opened, when said intake or exhaust valve is opened.

DETAILED DESCRIPTION OF PREFERRED EMBODIMENTS

Figure 5:
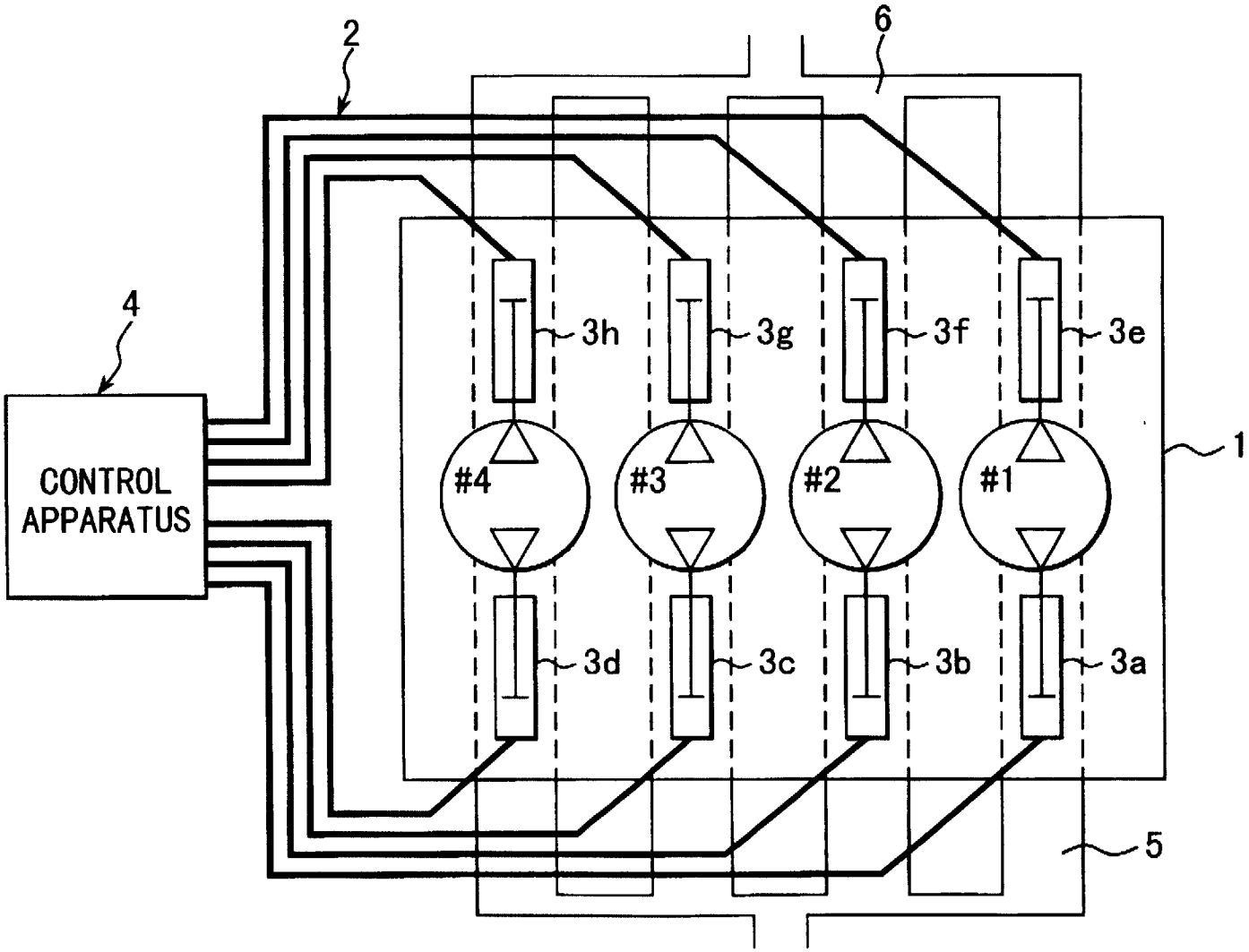
FIG. 5 is a schematic view showing an engine incorporating an elecromagnetically operated valve driving system.

Referring now to FIG. 5, numeral 1 denotes a four cylinder internal combustion engine incorporating an electromagnetically operated valve driving system. An intake passage 5 is connected with each of cylinders #1, #2, #3 and #4 of the engine 1 respectively and electromagnetically operated intake valves 3*a*, 3*b*, 3*d* and 3*d* are disposed respectively at the connecting portion of the intake passage 5 and the cylinder.

Further, an exhaust passage 6 is connected with respective cylinders #1, #2, #3 and #4 and electromagnetically operated exhaust valves 3*e*, 3*f*, 3*g* and 3*h* are disposed respectively at the connecting portion of the exhaust passage 6 and the cylinder.

These electromagnetically operated intake and exhaust valves 3*a* through 3*h* are connected with a control apparatus 4, thus constituting an electromagnetically operated valve driving system 2. These intake and exhaust valves are operated by the driving signal from the control apparatus 4 so as to open and close at an individual timing.

Figure 6:
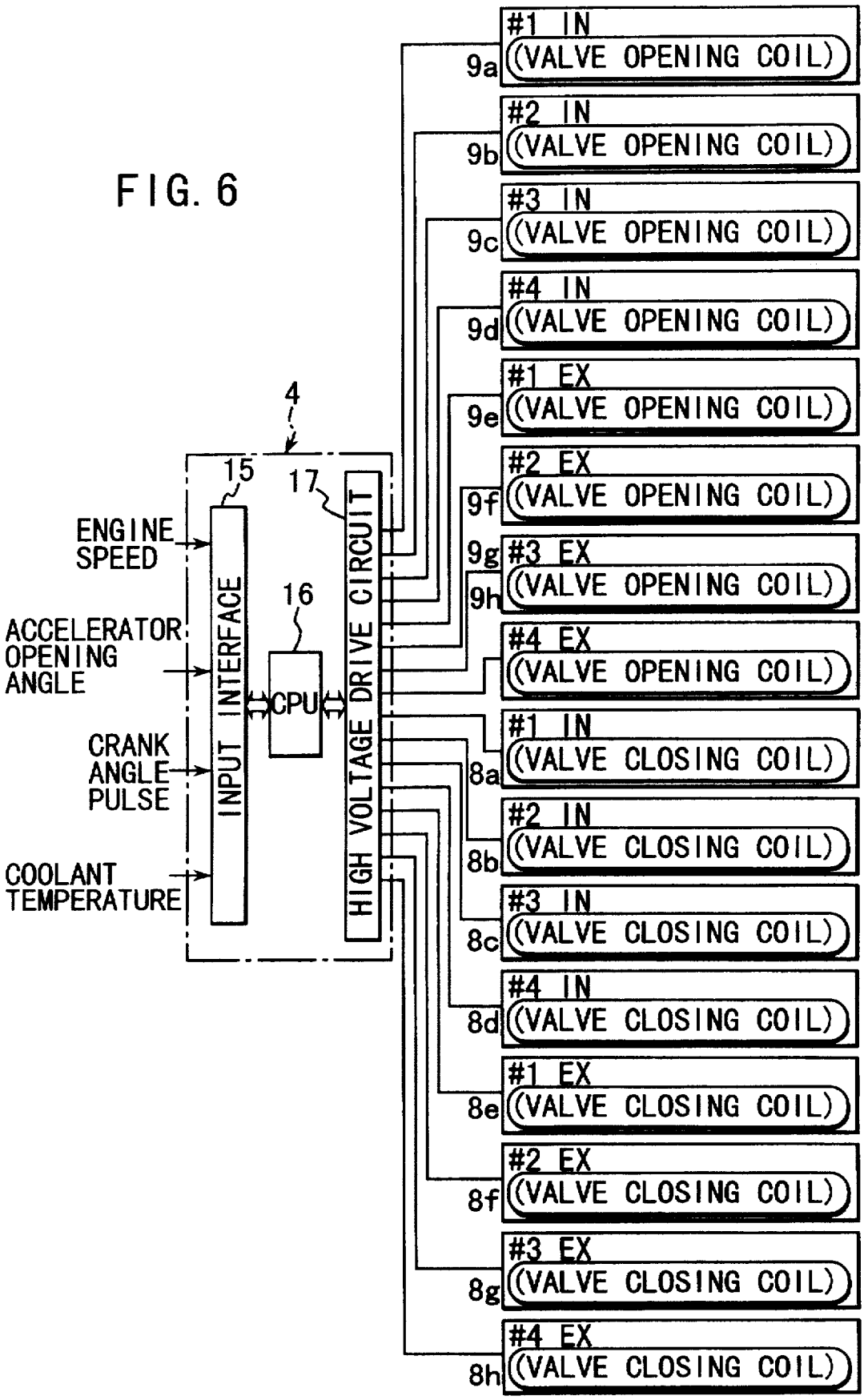
FIG. 6 is a circuit diagram of an electromagnetically operated valve driving system.
Figure 7:
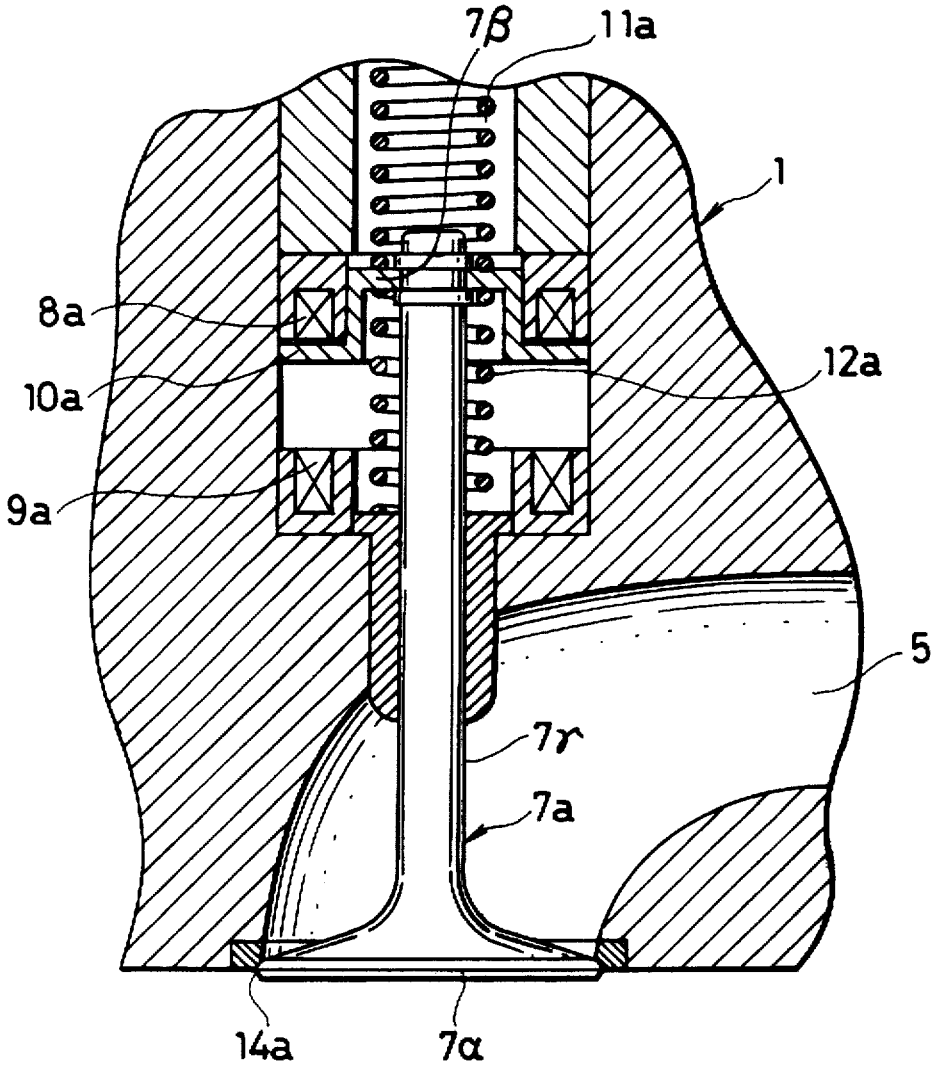
FIG. 7 is a schematic drawing of an electromagnetically operated valve driving system.

Referring to FIGS. 5, 6 and 7, the electromagnetically operated intake valve 3*a* is composed of an electromagnetic solenoid 9*a* for opening valve (hereinafter referred to as valve opening solenoid), an electromagnetic solenoid 8*a* for closing valve (hereinafter referred to as valve closing solenoid) and a valve 7*a* operated by the magnetic field energized with these solenoids.

Similarly, the electromagnetically operated intake valve 3*b* comprises a valve opening solenoid 9*b*, a valve closing solenoid 8*b* and a valve 7*b*. Further, similarly, the intake and exhaust valves 3*c* through 3*h* are composed of corresponding solenoids and valves.

The control apparatus 4, as shown in FIG. 6, is composed of an input interface 15, a CPU 16 and a high voltage drive circuit 17.

Miscellaneous sensors (not shown) are connected with the input interface 15 to which miscellaneous data such as an engine speed, an accelerator opening angle, a crank angle, a coolant temperature and the like are inputted therefrom.

Based on these inputted data, the CPU 16 calculates opening and closing timing of the electromagnetically operated intake valves 3*a* through 3*d* and the electromagnetically operated exhaust valves 3*e* through 3*h* and then the high voltage drive circuit 17 outputs a drive signal at the calculated timing to the valve opening solenoids 9*a* through 9*h* and the valve closing solenoids 8*a* through 8*h*, respectively.

FIG. 7 shows a construction of the electromagnetically operated intake valve 3*a*, which comprises a valve 7*a*, a valve closing solenoid 8*a* for closing the valve 7*a*, a valve opening solenoid 9*a* for opening the valve 7*a*, a valve opening spring 11*a* and a valve closing spring 12*a*.

The valve 7*a* has a valve head 7α at the one end thereof and a spring retainer 7β is mounted at the other end of the valve stem 7γ. An armature 10*a* is integrally formed with the spring retainer 7β in order to open and close the valve 7*a* by energizing the valve opening solenoid 8*a* and the valve closing solenoid 9*a*.

The valve 7*a* is disposed in the engine 1 so that its valve head 7α seals a valve seat 14*a* provided at the connecting portion of the #1 cylinder and the intake passage 5 when the valve 7*a* comes to a closing position.

Further, there are provided with the cylindrical valve opening and closing solenoids 9*a* and 8*a* on the common axis with the valve stem 7γ at a specified interval, respectively and the armature 10*a* is disposed so as to reciprocate between both solenoids 9*a* and 8*a* in the direction of the axis of the valve stem 7γ.

The interval between both solenoids is established such that the valve 7*a* is fully closed when the armature 10*a* comes into contact with the valve closing solenoid 8*a* and it is fully opened when the armature 10*a* comes into contact with the valve opening solenoid 9*a*.

The spring retainer 7β is inserted between the valve opening spring 11*a* disposed in the cylindrical space provided above the valve closing solenoid 8*a* and the valve closing spring 12*a* disposed in the cylindrical inner space of the valve opening solenoid 9*a* on the same axis as the valve stem 7γ so as to balance on an intermediate position of the valve closing solenoid 8*a* and the valve opening solenoid 9*a*.

FIG. 7 shows an example of the electromagnetically operated valve using an intake valve 3*a*, however other intake valves 3*b* through 3*d* and the exhaust valves 3*e* through 3*h* are constituted similarly to the intake valve 3*a*.

Next, an operation of the elecromagnetically operated valve driving system 2 will be described referring to flowcharts in FIGS. 1, 2, 3 and 4 and a time chart in FIG. 8.

The control routines shown in these flowcharts are carried out every specified crank angle θ. Referring to a flowchart in FIG. 1, when the main routine starts, first at a step S1 an engine operating condition is detected, i.e., an engine speed, an accelerator opening angle, a crank angle signal, a coolant temperature and the like are detected. These detected data are sent to the CPU 16 of the control apparatus 4 where miscellaneous operating timings are calculated according to the following procedure.

First, at S2 opening and closing timings of the electromagnetically operated intake valves 3*a* through 3*d* and exhaust valves 3*e* through 3*h* are calculated. Next, at S3 an energizing timing of the valve opening solenoids 8*a* through 8*h* and the valve closing solenoids 9*a* through 9*h* are calculated, respectively and then at S4 a deenergizing pulse timing is calculated. The deenergizing pulse (hereinafter referred to as "off pulse") is a pulse for turning current to the solenoids off temporarily. Then, at S5 an energizing control routine is carried out and the program returns to START.

The energizing control routine is divided into a first energizing control routine for energizing or deenergizing respective valve opening solenoids 9*a* through 9*h* and a second energizing control routine for energizing or deenergizing respective valve closing solenoids 8*a* through 8*h*.

Figure 2:
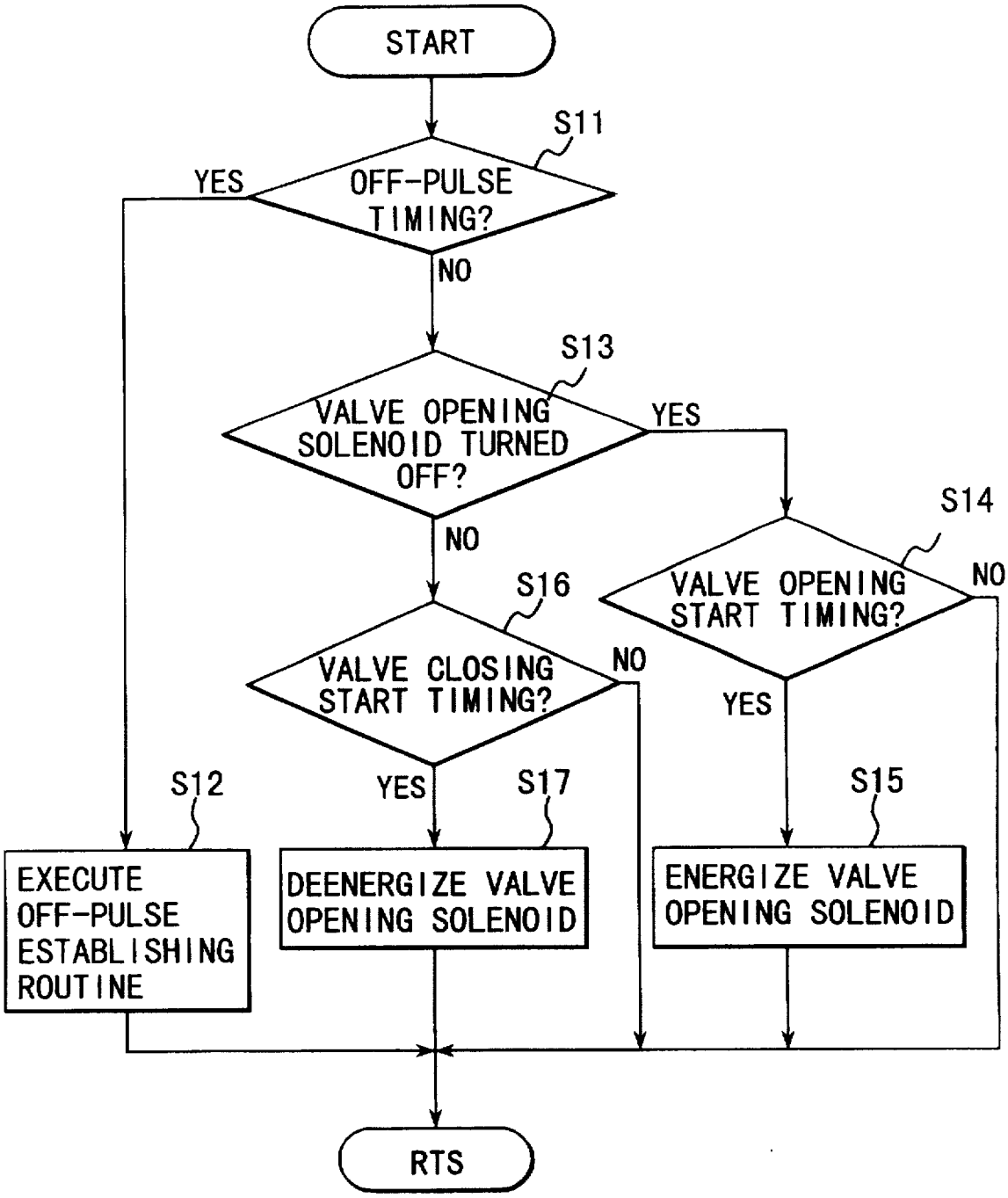
FIG. 2 is a flowchart showing a control routine for controlling a current supplied to a valve opening solenoid.

Referring to FIG. 2, the first energizing control routine will be described. When the routine starts, at S11 it is judged whether or not the crank timing coincides with a timing for outputting an off-pulse. If it is judged that the crank timing has coincided with a timing for outputting an off-pulse, the program goes to S12 where an off-pulse establishing routine is executed and then the program leaves the first energizing control routine. If it is judged that the crank timing is not a timing for outputting the off-pulse, the program goes to S13.

At S13, it is judged whether or not the valve opening solenoid is deenergized and if it is deenergized the program goes to S14. On the other hand, if the valve opening solenoid is energized, the program goes to S16.

At S14, it is judged whether or not the crank timing coincides with a timing for energizing the valve opening solenoid. If it is judged that the crank timing has coincided with a timing for energizing the valve opening solenoid, the program goes to S15 where the valve opening solenoid is energized and then the program leaves the routine. On the other hand, if it is judged that the crank timing is not a timing for energizing the valve opening solenoid, the program leaves the routine.

At S16, if it is judged whether or not the crank timing coincides with a timing for energizing the valve closing solenoid. If it is judged that the crank timing has coincided with a timing for energizing the valve closing solenoid, the program goes to S17 where the valve opening solenoid which has been energized is deenergized and the program leaves the routine. On the other hand, if it is judged that the crank timing is not a timing for energizing the valve closing solenoid, the program leaves the routine.

Next, the off-pulse establishing routine at S12 will be described with reference to FIG. 3. At S21, it is judged whether or not the crank timing coincides with a timing for cutting off the voltage applied to the valve opening (or closing) solenoid. If it is judged that the crank timing has coincided with a timing for cutting off that voltage, the program goes to S22 where the valve opening (or closing) solenoid is deenergized and the program steps to S23. On the other hand, if it is judged that the crank timing is not a timing for cutting off that voltage, or if the valve opening (closing) solenoid is not energized, the program skips to S23.

At S23, it is judged whether or not the crank timing coincides with a timing for applying voltage to the valve opening (closing) solenoid. If it is judged that the crank timing has coincided with a timing for applying voltage to the valve opening (or closing) solenoid, the program goes to S24 where the valve opening (or closing) solenoid is energized and then the program leaves the off-pulse establishing routine. On the other hand, if it is judged at S23 that the crank timing is not a timing for applying voltage to the valve (or closing) solenoid, or if the solenoid is energized, the program leaves the routine.

Figure 4:
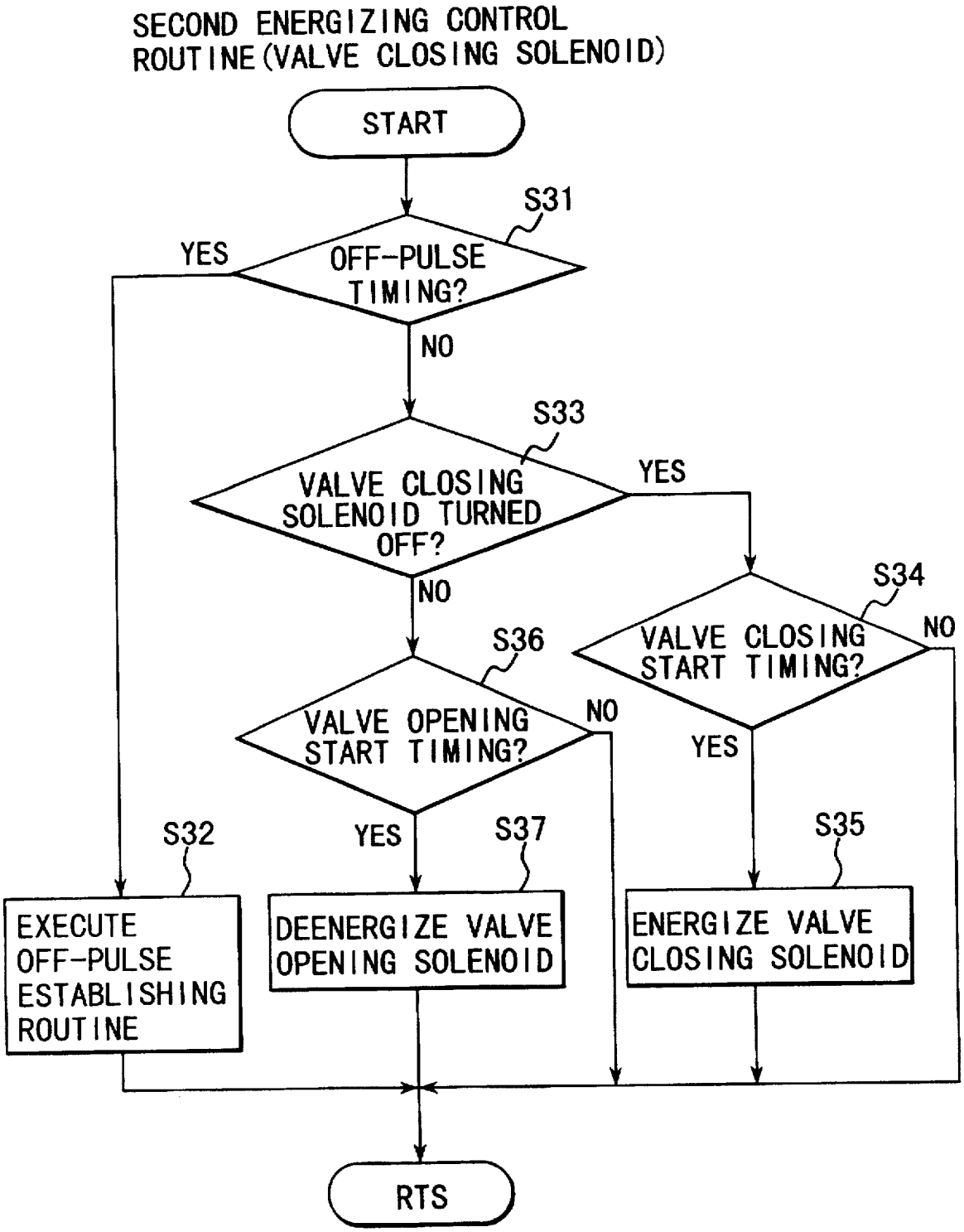
FIG. 4 is a flowchart showing a control routine for controlling a current supplied to a valve closing solenoid.

Referring to FIG. 4, the second energizing control routine will be described. When the routine starts, at S31 it is judged whether or not the crank timing coincides with a timing for outputting an off-pulse. If it is judged that the crank timing has coincided with a timing for outputting the off-pulse, the program goes to S32 where the off-pulse establishing routine is executed and then the program leaves the second energizing control routine. Here, the off-pulse establishing routine is executed in the same manner as in the case of the first energizing control routine. If it is judged that the crank timing is not a timing for outputting the off-pulse, the program goes to S33.

At S33, it is judged whether or not the valve closing solenoid is deenergized and if it is deenergized the program goes to S34. On the other hand, if the valve closing solenoid is energized, the program goes to S36.

At S34, it is judged whether or not the crank timing coincides with a timing for energizing the valve closing solenoid. If it is judged that the crank timing has coincided with a timing for energizing the valve closing solenoid, the program goes to S35 where the valve opening solenoid is energized and then the program leaves the routine. On the other hand, if the crank timing is not a timing for energizing the valve closing solenoid, the program leaves the routine.

At S36, if it is judged whether or not the crank timing coincides with a timing for energizing the valve opening solenoid. If it is judged that the crank timing has coincided with a timing for energizing the valve opening solenoid, the program goes to S37 where the valve opening solenoid which has been energized is deenergized and the program leaves the routine. On the other hand, if it is judged that the crank timing is not a timing for energizing the valve opening solenoid, the program leaves the routine.

Next, the relationship between the control voltage of the electromagnetically operated intake valve 3a and an operation of the valve 7a will be described with reference to FIG. 8.

Figure 8:
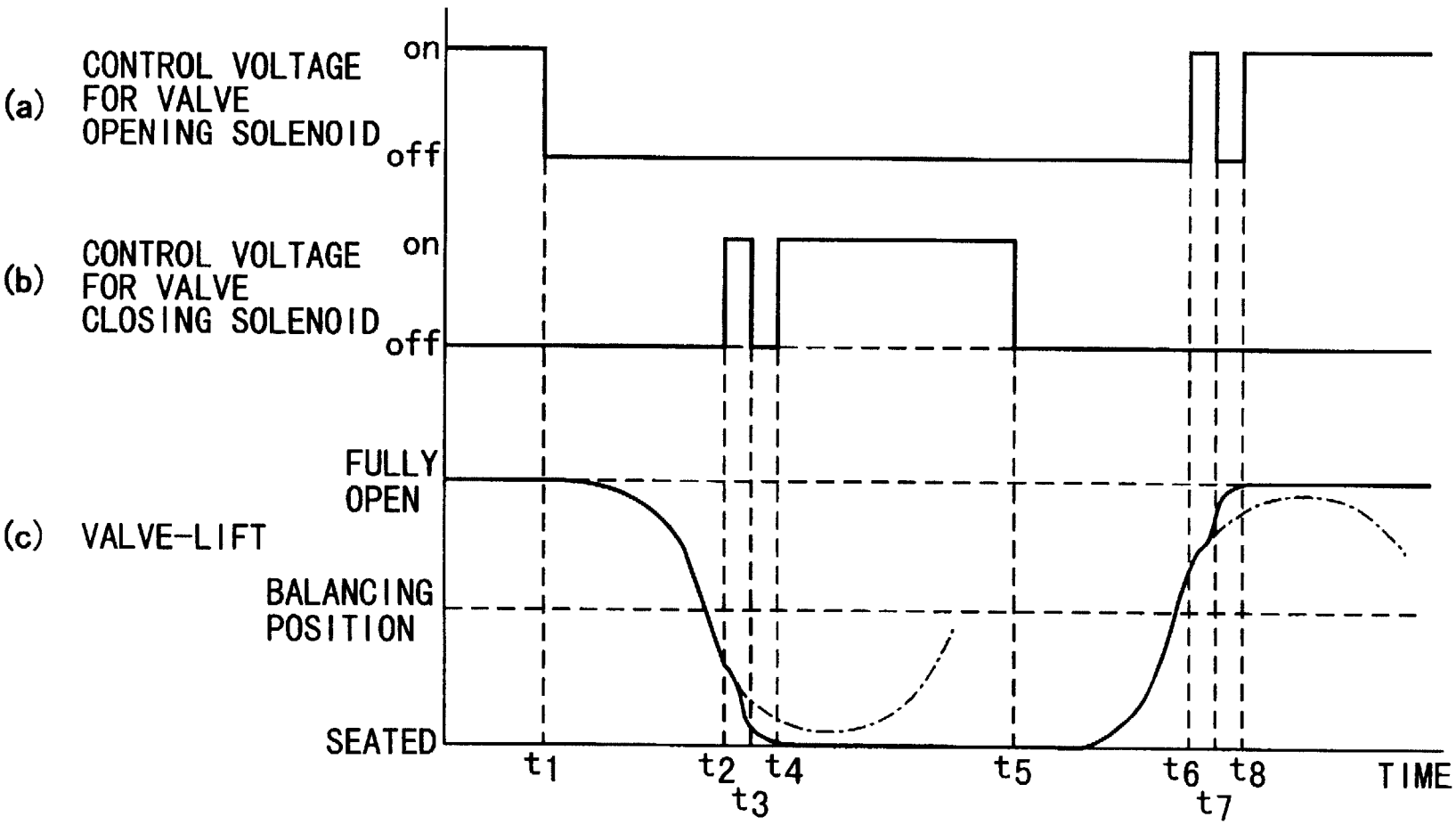
FIG. 8 is a time chart showing energizing and deenergizing timing of a current supplied to a valve opening and closing solenoids and a time chart showing a movement of a valve lift versus time.

In FIG. 8, a time chart (a) shows a control voltage applied to the valve opening solenoid 9a and a time chart (b) shows a control voltage applied to the valve closing solenoid 8a. Further, a time chart (c) indicates a valve lift corresponding to (a) and (b).

Figure 1:
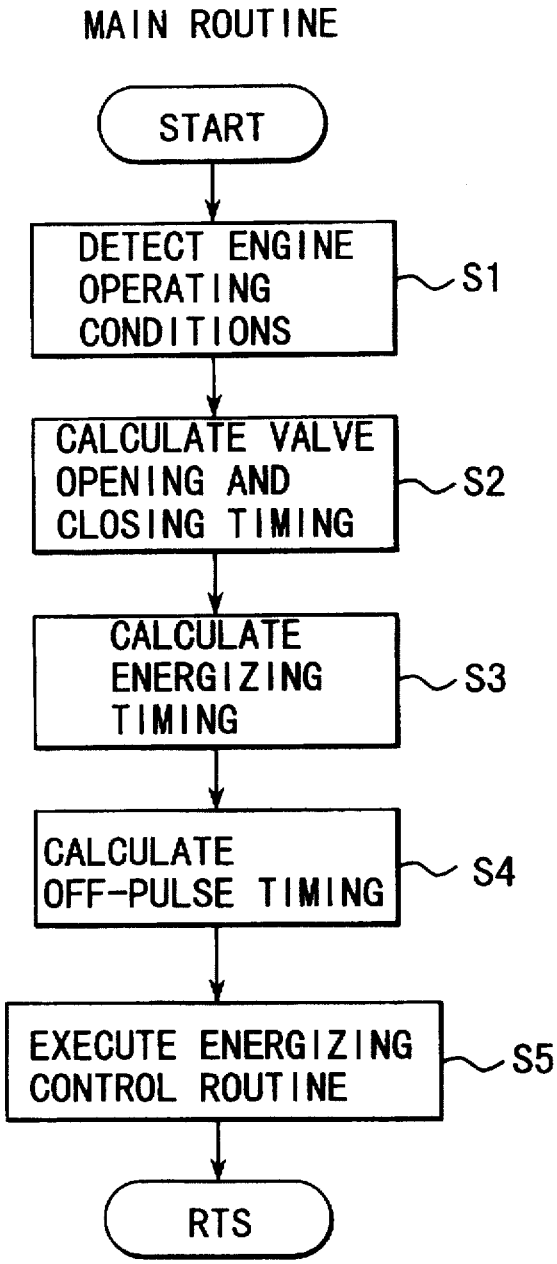
FIG. 1 is a flowchart showing a main control routine according to an embodiment of the present invention.

The main routine shown in FIG. 1 is executed every a specified crank angle θ, that is, calculations at S2 through S4 are repeated every crank angle θ based on the detected engine operating conditions and further the energizing control routine is carried out at S5 based on results of these calculations. The energizing control routine is executed according to the control routines shown in FIGS. 2, 3 and 4.

For example, when the electromagnetically operated intake valve 3a is open, the first energizing control routine shown in FIG. 2 is repeated every specified crank angle θ, taking such steps as START→S11→13→S16→RTS. In this state, the control voltage of the valve opening solenoid 9a (hereinafter referred to as "valve opening control voltage") is continued to be applied. On the other hand, the second energizing control routine as shown in FIG. 4 is repeated every specified crank angle θ, taking such steps as START→S31→33→S34→RTS and the control voltage of the valve closing solenoid 8a (hereinafter referred to as "valve closing control voltage") is continued to be turned off.

The valve opening solenoid 9a is energized by the valve opening control voltage and the armature 10a is attracted by the magnetic field of the valve opening solenoid towards the valve opening solenoid 9a so as to open the valve 7a.

When the crank angle reaches $\theta_1$ (corresponding to an event $t_1$ in FIG. 8), as shown in FIG. 2, the first energizing routine is repeated every specified crank angle, taking steps like START→S11→S13→S16→S17→RTS, then taking such steps as START→S11→S13→S14→RTS after the valve opening control voltage is turned off. As a result, the valve opening control voltage is continued to be turned off.

When the valve opening control voltage is turned off at the event $t_1$, by the restoring force directing to the balancing position of the valve opening spring 11 and the valve closing spring 12 the valve 7a directs towards the closing direction and it would indicate a movement as shown by a one-dot broken line, unless a voltage control is applied to the valve closing solenoid 8a. However, an actual movement of the valve 7a is as follows.

When the crank angle reaches $\theta_2$ (corresponding to an event $t_2$ in FIG. 8), the second energizing control routine shown in FIG. 4 takes such steps as START→S31→S33→S34→S35→RTS and the valve closing control voltage is turned on. After that, steps like START→S31→33→S36→RTS are repeated every specified crank angle and the valve closing control voltage is continued to be turned on.

When the valve closing control voltage is applied to the valve closing solenoid 8a at an event $t_2$, the valve closing solenoid 8a is energized to generate a magnetic field and the armature 10a is accelerated again towards the valve closing solenoid 8a against the restoring force directing to the balancing position of the valve opening spring 11a and the valve closing spring 12a.

When the crank angle reaches $\theta_3$ (corresponding to an event $t_3$ in FIG. 8), the routine shown in FIG. 4 takes steps like START→S31→S32→RTS and the same steps are repeated until the crank angle reaches $\theta_4$ (corresponding to an event $t_4$ in FIG. 8).

Figure 3:
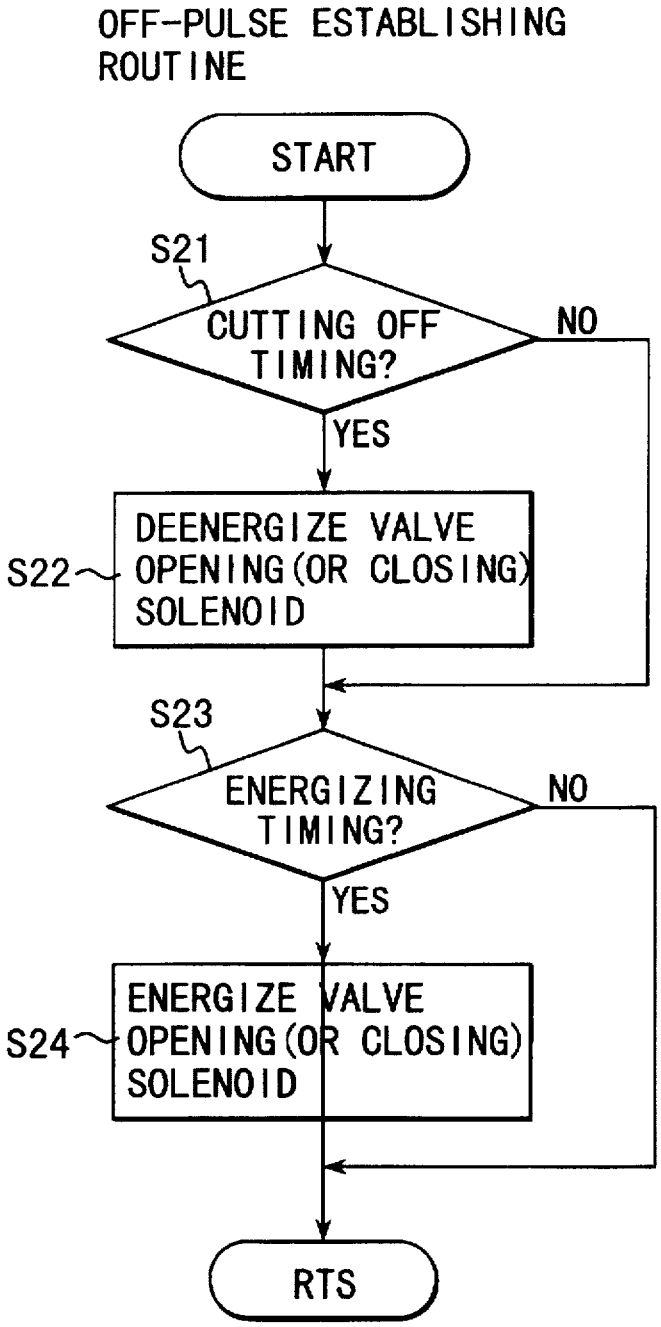
FIG. 3 is a flowchart showing a control routine for controlling a deenergizing pulse.

At the step S32 of the routine in FIG. 4, the off-pulse establishing routine as shown in FIG. 3 is executed. This off-pulse establishing routine takes such steps as START→S21→S22→S23→RTS at the crank angle $\theta_3$ and the valve closing control voltage is temporarily cut off. After that, steps START→S21→S23→RTS are repeated and the valve closing control voltage is continued to be turned off.

When the valve closing control voltage is turned off at $t_3$, the valve 7a and the armature 10a continues to move in the closing direction of the valve 7a but the speed thereof is reduced by the restoring force directing to the balancing position of the valve opening spring 11a and the valve closing spring 12a. As a result, the valve 7a is seated on the valve seat while it is decelerated and the lift curve is made round as shown in FIG. 8.

When the crank angle reaches $\theta_4$ (corresponding to an event $t_4$ in FIG. 8 and a timing immediately before the valve seating), the off-pulse establishing routine as shown in FIG. 3 takes steps like START→S21→S23→S24→RTS to turn the valve closing control voltage on. After that, the second energizing control routine as shown in FIG. 4 repeats steps START→S31→S33→S36→RTS to continue to turn the valve closing control voltage on.

Therefore, at $t_4$ the valve closing control voltage is applied again to the valve closing solenoid 8*a* and the armature 10*a* is attracted towards the valve closing solenoid 8*a*. As a result, the valve 7*a* is fully closed (seated on the valve seat).

When the valve is made open, the valve opening operation is performed at respective timings $t_5$, $t_6$, $t_7$ and $t_8$ and the valve reaches a fully open position while it is decelerated.

That is to say, when the valve closing control voltage is turned off at $t_5$, the valve 7*a* starts to move towards the valve opening solenoid 9*a*. At an event $t_6$, the valve opening control voltage is turned on and the valve 7*a* is accelerated in the valve opening direction.

Then, the valve opening control voltage is temporarily turned off between events $t_7$ and $t_8$ by an off-pulse and is turned on again at $t_8$. When the valve opening control voltage is turned off between $t_7$ and $t_8$, the traveling speed of the valve 7*a* is reduced by the restoring force directing to the balancing position of the valve opening spring 11*a* and the valve closing spring 12*a*. Further, when the valve opening control voltage is turned on at the event $t_8$ and the valve opening coil 9*a* is energized, the armature 10*a* is attracted towards the valve opening solenoid 9*a* and the valve 7*a* is made fully open.

Thus, according to the embodiment of the present invention, the traveling speed of the valve 7*a* can be controlled immediately before the valve 7*a* is seated or fully open by means of temporarily energizing the valve closing solenoid 8*a* or the valve opening solenoid 9*a*. The control of the traveling speed of the valve 7*a* enables to alleviate the impact of the valve 7*a* when it is seated or fully open, whereby not only noises due to the valve opening and closing operations can be reduced but also the durability of the valve 7*a* itself can be greatly improved.

Further, since the traveling speed of the valve 7*a* is controlled by the electromagnetic solenoid close to the armature 10*a*, more excellent controllability of the valve 7*a* can be obtained.

With respect to other intake valves 3*b* through 3*d* and exhaust valves 3*e* through 3*h*, the same operation as the intake valve 3*a* is performed according to the same control of the valve opening and closing solenoids.

In this embodiment, the off-pulse is outputted once per one opening or closing operation of the valve, however the off-pulse may be outputted more than once within one opening or closing operation of the valve according to the valve speed, the output timing of pulse, the magnitude of magnetic field of the electromagnetic solenoids and the like.

In summary, according to the present invention, since when the valve is opened power to the valve opening solenoid is disconnected temporarily and when the valve is closed power to the valve closing solenoid is disconnected, the traveling speed of the valve immediately before it is seated or fully open can be alleviated, this enabling to reduce the impact of the valve when it is seated or fully open. The reduction of the impact leads to reduced noises and an improved durability of the valve body.

What is claimed is:

1. An electromagnetically operated valve driving system of an engine having a combustion chamber, an intake or exhaust valve including a valve body for opening and closing said combustion chamber, a valve stem for supporting said valve body, an armature connected with said valve stem, a first solenoid for attracting said armature and for driving said valve body so as to open said combustion chamber and a second solenoid for attracting said armature and for driving said valve body so as to close said combustion chamber, and a control apparatus for energizing or deenergizing said first and second solenoids, comprising:

at least one spring for balancing said valve body on a specified position between the fully open and fully closed positions of said valve body and for exerting a restoring force of said valve body; and valve closing control means for at least once stopping energizing said second solenoid immediately before said intake or exhaust valve is fully closed, so as to reduce a traveling speed of said valve body when said valve body is seated, when said intake or exhaust valve is closed.

2. An electromagnetically operated valve driving system of an engine having a combustion chamber, an intake or exhaust valve including a valve body for opening and closing said combustion chamber, a valve stem for supporting said valve body, an armature connected with said valve stem, a first solenoid for attracting said armature and for driving said valve body so as to open said combustion chamber and a second solenoid for attracting said armature and for driving said valve body so as to close said combustion chamber, and a control apparatus for energizing or deenergizing said first and second solenoids, comprising:

at least one spring for balancing said valve body on a specified position between the fully open and fully closed positions of said valve body and for exerting a restoring force of said valve body; and valve opening control means for at least once stopping energizing said first solenoid immediately before said intake or exhaust valve is fully opened, so as to reduce a traveling speed of said valve body when said valve body is fully opened, when said intake or exhaust valve is opened.

* * * * *